United States Patent [19]

Chaffee

[11] 3,990,220

[45] Nov. 9, 1976

[54] METHOD AND APPARATUS FOR FORMING WOUND MUSIC STRING

[75] Inventor: William H. Chaffee, Chicago, Ill.

[73] Assignee: Model Builders, Inc., Chicago, Ill.

[22] Filed: May 27, 1975

[21] Appl. No.: 581,420

[52] U.S. Cl. ..... 57/11; 57/160

[51] Int. Cl.[2] ..... D02G 3/38; D02G 3/44

[58] Field of Search ..... 57/3, 6, 10, 11, 18, 57/160

[56] References Cited

UNITED STATES PATENTS

| | | | |
|---|---|---|---|
| 515,597 | 2/1894 | Lyon | 57/10 |
| 2,241,283 | 5/1941 | Wackerle | 57/6 X |
| 2,334,880 | 11/1943 | Marlow | 57/18 |
| 3,262,256 | 7/1966 | Vinciguerra | 57/11 |
| 3,646,743 | 3/1972 | Boyd | 57/34 R X |
| 3,732,679 | 5/1973 | Sohr | 57/6 X |
| 3,756,004 | 9/1973 | Gore | 57/160 X |

FOREIGN PATENTS OR APPLICATIONS

| | | | |
|---|---|---|---|
| 458,337 | 3/1928 | Germany | 57/11 |
| 143,677 | 6/1920 | United Kingdom | 57/11 |

*Primary Examiner*—Donald E. Watkins

*Attorney, Agent, or Firm*—Wegner, Stellman, McCord, Wiles & Wood

[57] ABSTRACT

A method of forming a wound musical instrument string wherein a core wire is fed axially along a preselected path while being rotated at high speed and a wrap wire is caused to be wrapped about the advancing rotating core wire. The wrapped core wire may additionally be driven. The drive may comprise rollers engaging the core wire prior to the wrapping operation and may include rollers engaging the wrapped wire subsequent to the wrapping operation.

20 Claims, 6 Drawing Figures

METHOD AND APPARATUS FOR FORMING WOUND MUSIC STRING

BACKGROUND OF THE INVENTION

1. Field of the Invention

This invention relates to musical instrument components and in particular to the manufacture of musical instrument strings of the wound type.

2. Description of the Prior Art

In conventional forming of wound musical instrument strings, balancing and rotational inertia problems present serious limitations on the speed of manufacture. In one prior method, a coil of core wire is revolved at high speed presenting balancing and bearing capacity problems and requiring limitations in size and weight of the revolving means.

SUMMARY OF THE INVENTION

The present invention comprehends an improved method and apparatus for forming a wound musical instrument string which eliminates the high inertia and balancing problems of the prior art string-forming apparatuses, and which permits high speed, low maintenance manufacture of such strings.

More specifically, the present invention comprehends providing core wires in discrete lengths to a wrapping position. The core wires are fed axially along a preselected path while being rotated at high speed whereby the wrapped wire may be delivered transaxially to the core wire and caused to be helically wrapped thereabout to define the desired composite wound string.

In the present invention, the wrapped core wire may further be driven axially and rotatively to further facilitate the manufacture.

In the illustrated invention, the core wire may be rotated at a speed of over 1000 rpm and, illustratively, may be rotated at extremely high speeds, such as over 50,000 rpm.

The means for driving and rotating the core wire may comprise drive rollers skewed to the axis of the core wire. In the illustrated embodiment, the skew angle is the same as the helical angle of the wrapped wrap wire. The drive of the wrapped core wire may be effected by rollers engaging the wrap wire and skewed to the axis of the core wire at the helix angle.

The wrap wire may be introduced onto the core wire through a guide disposed downstream of the means for driving and rotating the core wire. Alternatively, the wrap wire may be introduced onto the core wire at the means for advancing and rotating the core wire.

The core wire may be supported in a tubular support and the wrapped core wire may be similarly supported in a similar tubular support during the advance thereof through the apparatus.

The speed of advance of the core wire, the rate of rotation thereof, and the rate of delivery of the wrapped wire are suitably coordinated to assure a tight wrapping of the wrap wire about the core wire to provide the desired wound instrument string.

Thus, the invention comprehends an improved method and an apparatus for forming a wound musical instrument string which is extremely simple and economical while yet providing improved manufacture thereof.

BRIEF DESCRIPTION OF THE DRAWING

Other features and advantages of the invention will be apparent from the following description taken in connection with the accompanying drawing wherein.

DESCRIPTION OF THE PREFERRED EMBODIMENTS

Figure 1:
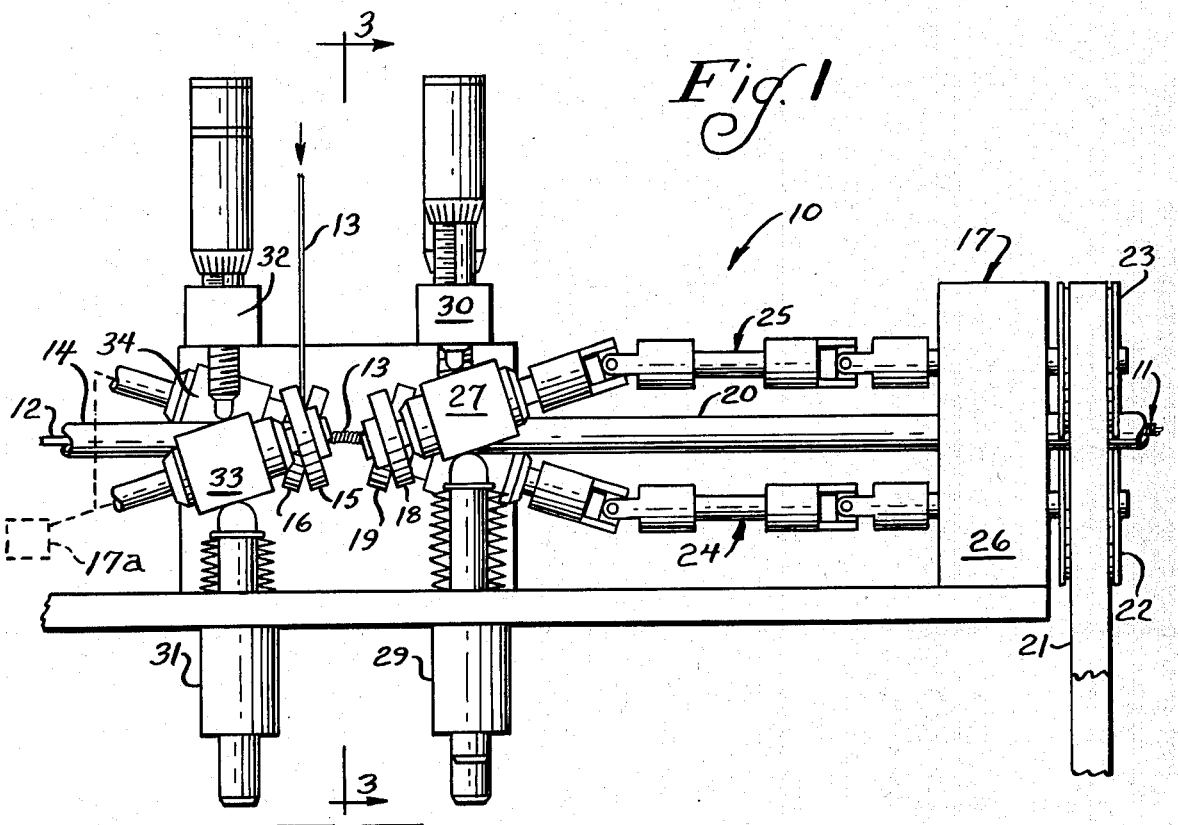
FIG. 1 is a top plan view of an apparatus embodying the invention.
Figure 2:
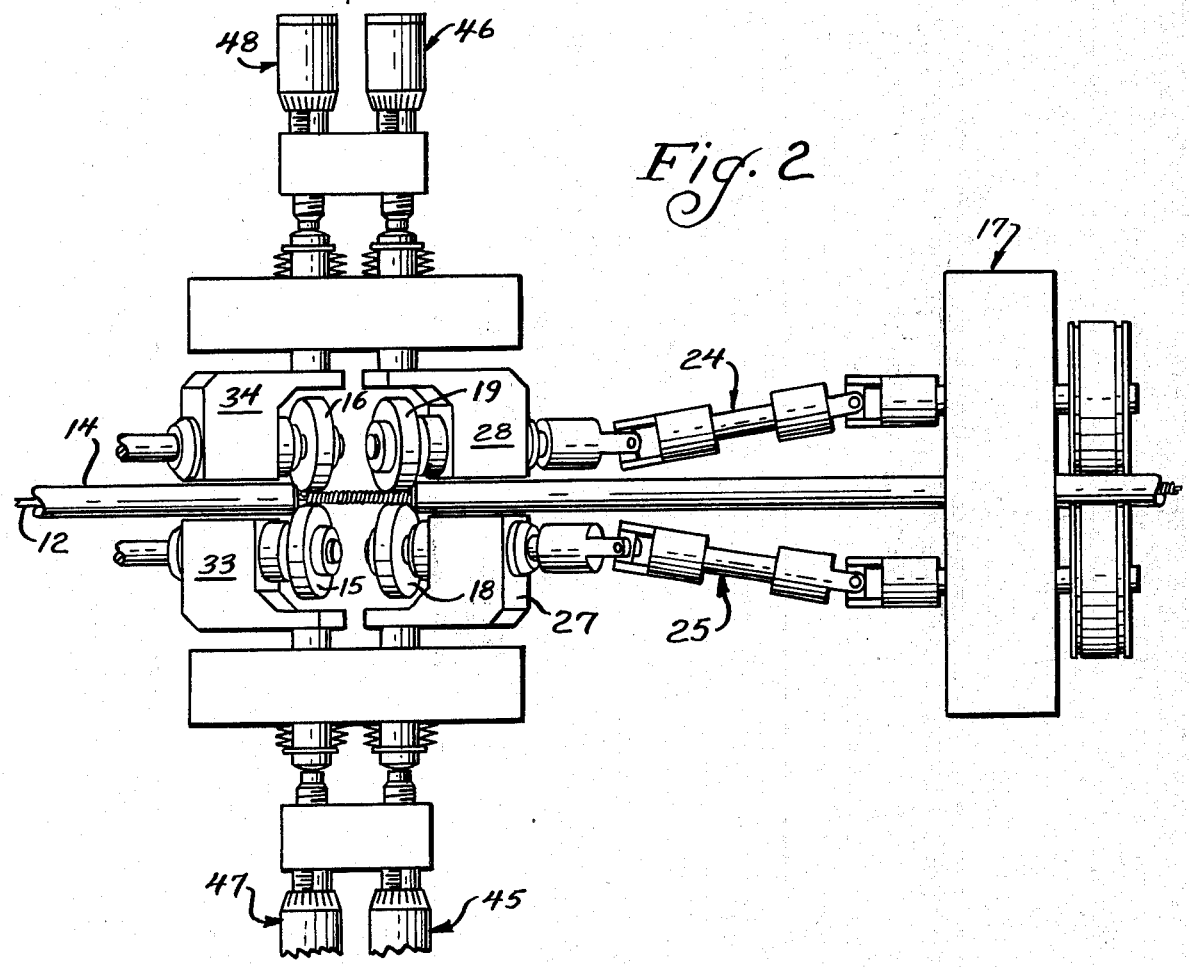
FIG. 2 is a side elevation thereof.

In the exemplary embodiment of the invention as disclosed in FIGS. 1 and 2 of the drawing, an apparatus generally designated 10 is provided for forming a wound musical instrument string generally designated 11 comprising a core wire 12 and a wrap wire 13 which is tightly helically wrapped about the core wire by means of apparatus 10.

The invention comprehends providing the core wire 12 in discrete lengths generally corresponding to the length of the desired musical instrument string and introducing the core wire through a tubular guide 14 to a wrapping position wherein the wrap wire 13 is wrapped tightly about the core wire. As shown in FIGS. 1 and 2, the core wire is rotatably advanced by the engagement therewith of a pair of rollers 15 and 16 at the exit end of the tubular guide 14. The rollers are oppositely skewed to the axis of the core wire and more specifically, may be skewed at the helix angle of the helically wrapped wrap wire 13, with roller 16 being skewed parallel thereto and roller 15 being skewed oppositely thereto. The rollers may be driven by a suitable rotating mechanism which may be similar to mechanism 17 provided for rotating a second set of rollers 18 and 19. The second set of rollers is arranged to engage the wrapped wrap wire 13 to drive the wrapped core through a discharge guide tube 20 for delivery therefrom as the desired wound music string. As shown, the drive mechanism may include a drive belt 21 driving a pair of pulleys 22 and 23. A pair of universal linkages 24 and 25 are connected to a suitable transmission 26 driven by the pulleys 22 and 23 for rotating the rollers 18 and 19. The rollers are rotatably carried by supports 27 and 28 which are adjustably positionable by means of suitable adjustable carrier 29 and 30 to arrange the rollers at the desired skew angle in engagement with the outer surface of the wrapped wire 13.

As indicated above, rollers 15 and 16 are driven by an identical mechanism **17*a* and are supported on similar adjustable carriers 31 and 32 and supports 33 and 34**.

As shown in FIG. 2, the wrap wire 13 may be brought into engagement with the core wire at the advance rollers 15 and 16 by being inserted between one roller, such as roller 16' and the core wire 12 thereat. It has been found that this insertion causes the wrap wire to wrap about the core wire and to be so wrapped in a helical configuration with the wrapped wrap wire being tightly wound on the core wire and with the turns of the helical wrapped wire 13 in abutment with each other to define the desired tightly wrapped musical instrument string.

The use of the second set of drive rollers 18 and 19 has been found desirable to provide a further move positive delivery of the string 11.

Illustratively, the core wire may have a relatively small diameter, such as approximately 0.012–0.025″. With the wrap wire 13 wrapped thereabout, the composite wound string may have a diameter of approximately 0.09″ or less. Thus, the rotating core wire 12 and wrapped wire 11 may be spun at high speed in the present manufacturing method with minimum problems of balancing as is present in the prior art string winding systems. Illustratively, the wire element may be rotated at a speed of over 1000 rpm and more specifically, may be spun at a speed of over 50,000 rpm.

No special bearings are required for supporting the wire as both the core wire and wrap wire may be suitably supported in the tubular guides which effectively stabilize the wire and prevent whipping and distortion thereof in the manufacturing operation.

The rollers may be driven by the drive mechanisms 17 so as to effectively drive the wire at similar speeds.

Upon completion of the winding of the wrap wire about the core wire to form the composite string 11, the string may be removed from the guide 20 and finishing operation, such as installation of a ball end, on one end of the wire may be effected.

The bore of guides 14 and 20 is preferably large enough to permit free movement of the spinning wire therein while being preselected to prevent undesirable lateral movement of the wire as discussed above.

Figure 3:
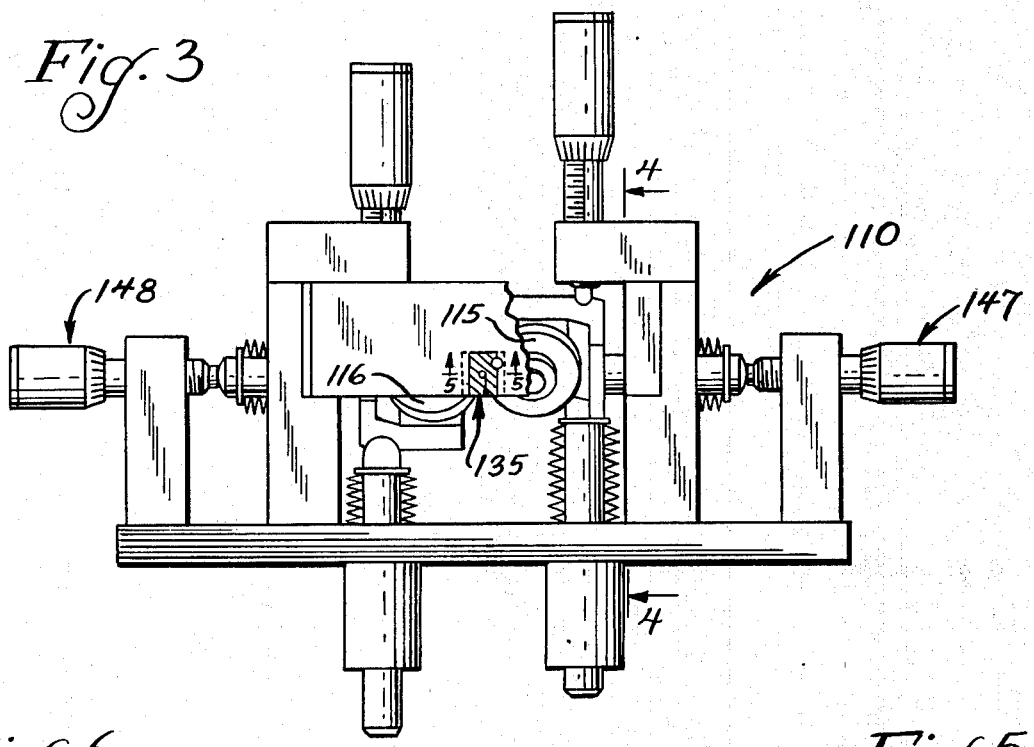
FIG. 3 is an end view partially in section illustrating a modified form thereof.
Figure 6:
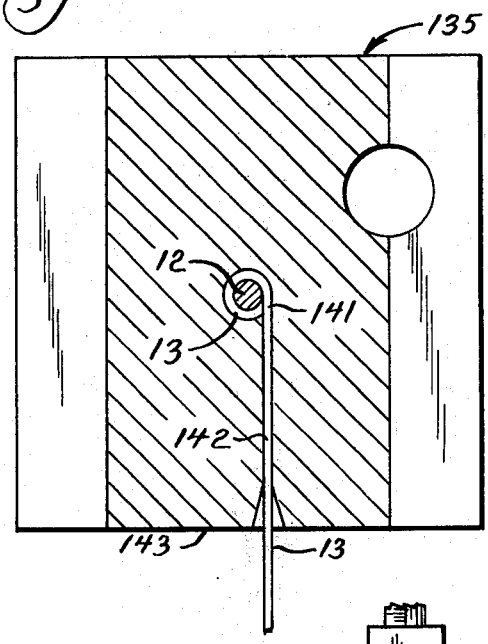
FIG. 6 is a vertical section taken substantially along the line 6—6 of FIG. 5.
Figure 5:
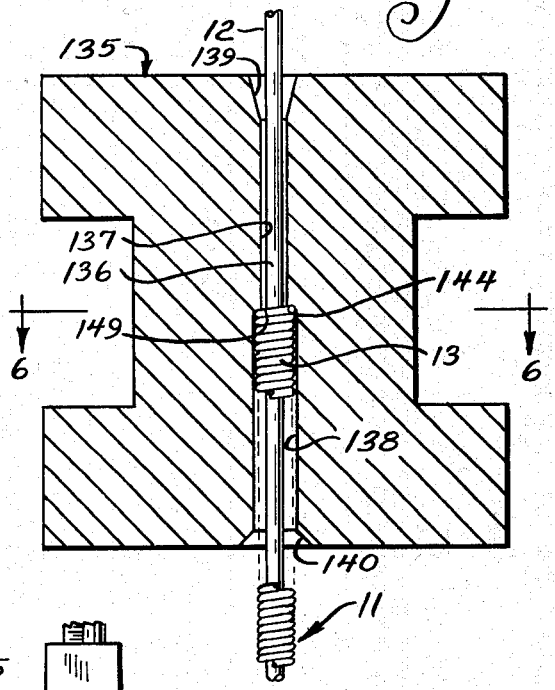
FIG. 5 is an enlarged horizontal section of the wrap wire feed means taken substantially along the line 5—5 of FIG. 3.
Figure 4:
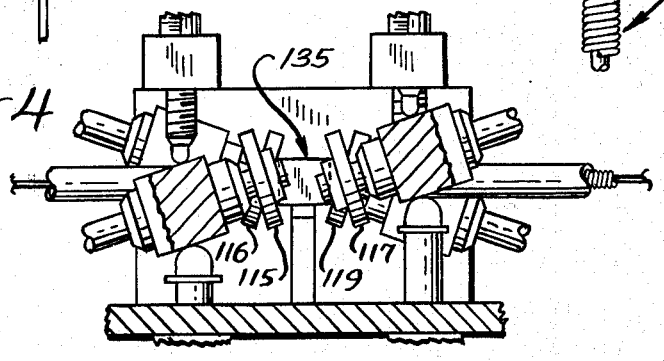
FIG. 4 is a fragmentary side view of the modified form of FIG. 3.

Referring now to the embodiment of FIGS. 3–6, a modified manufacture of the wound string 11 is shown to utilize an apparatus generally designated 110 which is similar to apparatus 10 except for the provision of a feedblock generally designated 135 for use in feeding the wrap wire 13 about the core wire 12. As illustrated in FIGS. 3 and 4, the feedblock 135 may be disposed intermediate the two sets of drive rollers 115, 116 and 118, 119. Block 135 includes a horizontal through bore generally designated 136 having a small diameter portion 137 and a large diameter portion 138. Bore portion 136 is provided with a frustoconical entrance portion 139 and bore portion 138 is provided with a furstoconical exit portion 140, as best seen in FIG. 5. Core wire 12 is fed through bore portion 136 past the inner end 141 of a transverse bore 142 opening through one face 143 of the feedblock 135. The wrap wire 13 is fed through bore 142 tangentially to the core wire at the inner end 144 of the large diameter portion 138 of bore 136. It has been found that the end of the wrap wire tends to lock itself onto the core wire as the core wire is moved axially and rotatably outwardly through bore portion 138 to form a tight helix about the core wire, as shown in FIG. 5. The rate of delivery of the wrap wire 13 is coordinated with the delivery of the core wire to assure the tight winding of the wrap wire on the core wire to define the desired wound musical instrument string 11, as discussed above.

As shown in FIG. 5, the surface 149 at the inner end of the bore portion 138 may be inclined at the desired helix angle to assist in starting the helical of wrap wire 13 about the core wire 12 and to guide the wrap wire into the helical configuration during the wrapping operation.

Except for the difference in feeding the wrap wire onto the core wire, the apparatus and method of FIGS. 3–6 are similar to those of the embodiment of FIGS. 1 and 2 and similar elements are identified by similar reference numerals but 100 higher.

In each of the apparatuses 10 and 110, means may be provided for adjustably engaging the rollers with the core wire and wrap wire, respectively, as illustrated in FIGS. 2 and 3. Thus, supports 27 and 28 may be horizontally adjustably spaced by means of adjustable mechanisms 45 and 46, respectively, and supports 33 and 34 may be horizontally adjustably spaced by adjustable mechanisms 47 and 48, respectively.

The foregoing disclosure of specific embodiments is illustrative of the broad inventive concepts comprehended by the invention.

I claim:

1. The method of forming a wound musical instrument string comprising: feedng a discrete length of core wire axially along a preselected path while rotating the entire core wire about the axis thereof; and wrapping a wrap wire helically about said length of advancing rotating core wire at a preselected rate coordinated with the axial feed of the core wire to define a composite wound string.

2. The method of forming a wound musical instrument string of claim 1 wherein the wrapped wire is driven along said preselected path.

3. The method of forming a wound musical instrument string of claim 1 wherein said wrap wire is fed transaxially against said rotating and advancing core wire to effect said helical wrapping.

4. The method of forming a wound musical instrument string comprising: feeding a core wire axially along a preselected path while rotating the core wire about the axis thereof at a speed of over 1000 rpm; and wrapping a wrap wire helically about the advancing rotating core wire at a preselcted rate coordinated with the axial feed of the core wire to define a composite wound string.

5. The method of forming a wound musical instrument string of claim 4 wherein said core wire is rotated at a speed of over 50,000 rpm.

6. The method of forming a wound musical instrument string comprising: feeding a preselected length of core wire axially along a preselected path while rotating the core wire about the axis thereof; and wrapping a wrap wire helically about the advancing rotating core wire at a preselected rate coordinated with the axial feed of the core wire to define a composite wound string.

7. The method of forming a wound musical instrument string of claim 1 including the step of rotatively driving the wrapped core wire.

8. Apparatus for forming a wound musical instrument string comprising: means for feeding a discrete length of core wire axially along a preselected path while rotating the entire core wire about the axis thereof; and means for wrapping a wrap wire helically about said length of advancing core wire at a preselected rate coordinated with the axial feed of the core wire to define a composite wound string.

9. The string forming apparatus of claim 8 including means for rotatively driving the wrapped wire.

10. Apparatus for forming a wound musical instrument string comprising: means for feeding a core wire axially along a preselected path while rotating the core wire about the axis thereof including a plurality of rotary drive elements peripherally engaging said core wire and means for rotating the drive elements about axes skewed to the axis of the core wire; and means for wrapping a wrap wire helically about the advancing core wire at a preselected rate coordinated with the axial feed of the core wire to define a composite wound string.

11. The string forming apparatus of claim 10 wherein said drive elements comprise rollers engaging said core wire at diametrically opposite portions thereof.

12. Apparatus for forming a wound musical instrument string comprising: means for feeding a core wire axially along a preselected path while rotating the core wire about the axis thereof; means for wrapping a wrap wire helically about the advancing core wire at a preselected rate coordinated with the axial feed of the core wire to define a composite wound string; and means for rotatively driving the wrapped wire comprising a plurality of rotary drive elements peripherally engaging said wrapped wire and means for rotating the drive elements about axes skewed to the axis of the core wire.

13. The string forming apparatus of claim 8 including a tubular guide for carrying said core wire to said feeding means.

14. The string forming apparatus of claim 8 including a tubular guide for carrying said wound string from said wrapping means.

15. The string forming apparatus of claim 8 including means for rotatively driving the wrapped wire and a tubular guide for carrying said wound string from said wrapping means.

16. The string forming apparatus of claim 8 wherein said core wire has a diameter of less than approximately one-third the diameter of the composite wound string.

17. The string forming apparatus of claim 8 wherein said wrapping means is arranged to cause the turns of said helically wrapped wrap wire to abut.

18. The string forming apparatus of claim 8 wherein said wrapping means is arranged to wrap the wrap wire tightly about said core wire.

19. The string forming apparatus of claim 10 wherein said axes are skewed to the axis of the core wire at the helix angle of said helically wrapped wrap wire.

20. The string forming apparatus of claim 12 wherein said axes are skewed to the axis of the core wire at the helix angle of said helically wrapped wrap wire.

* * * * *